US009505234B2

(12) United States Patent
Bannai et al.

(10) Patent No.: US 9,505,234 B2
(45) Date of Patent: Nov. 29, 2016

(54) INKJET RECORDING METHOD AND INKJET RECORDING DEVICE

(71) Applicants: Akiko Bannai, Kanagawa (JP); Hidefumi Nagashima, Kanagawa (JP); Mariko Kojima, Tokyo (JP); Michihiko Namba, Kanagawa (JP)

(72) Inventors: Akiko Bannai, Kanagawa (JP); Hidefumi Nagashima, Kanagawa (JP); Mariko Kojima, Tokyo (JP); Michihiko Namba, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/152,431

(22) Filed: Jan. 10, 2014

(65) Prior Publication Data

US 2014/0192121 A1 Jul. 10, 2014

(30) Foreign Application Priority Data

Jan. 10, 2013 (JP) ..... 2013-002293
Dec. 25, 2013 (JP) ..... 2013-267185

(51) Int. Cl.

| | |
|---|---|
| ***B41J 2/01*** | (2006.01) |
| ***B41J 11/00*** | (2006.01) |
| ***B41J 2/21*** | (2006.01) |
| ***B41M 7/00*** | (2006.01) |

(52) U.S. Cl.
CPC ..... *B41J 11/0015* (2013.01); *B41J 2/2114* (2013.01); *B41M 7/0036* (2013.01)

(58) Field of Classification Search
CPC ..... B41J 2/211; B41J 2/2114; B41J 2/2117
See application file for complete search history.

(56) References Cited

U.S. PATENT DOCUMENTS

| | | | | |
|---|---|---|---|---|
| 5,514,208 | A | 5/1996 | Nagai et al. | |
| 5,622,550 | A | 4/1997 | Konishi et al. | |
| 5,810,915 | A | 9/1998 | Nagai et al. | |
| 5,879,439 | A | 3/1999 | Nagai et al. | |
| 5,882,390 | A | 3/1999 | Nagai et al. | |
| 5,972,082 | A | 10/1999 | Koyano et al. | |
| 5,993,524 | A | 11/1999 | Nagai et al. | |
| 6,066,692 | A * | 5/2000 | Tien et al. | 524/507 |
| 6,120,589 | A | 9/2000 | Bannai et al. | |
| 6,231,652 | B1 | 5/2001 | Koyano et al. | |
| 6,261,349 | B1 | 7/2001 | Nagai et al. | |
| 6,467,891 | B2 * | 10/2002 | Moriyama et al. | 347/96 |
| 6,613,136 | B1 | 9/2003 | Arita et al. | |
| 7,510,253 | B2 * | 3/2009 | Tatsumi | 347/14 |
| 2002/0044187 | A1 * | 4/2002 | Koitabashi | B41J 2/2114 347/101 |
| 2002/0083866 | A1 | 7/2002 | Arita et al. | |
| 2002/0096085 | A1 | 7/2002 | Gotoh et al. | |
| 2003/0064206 | A1 | 4/2003 | Koyano et al. | |
| 2003/0076394 | A1 | 4/2003 | Gotoh et al. | |
| 2003/0107632 | A1 | 6/2003 | Arita et al. | |

(Continued)

FOREIGN PATENT DOCUMENTS

| | | |
|---|---|---|
| JP | 2004-181688 | 7/2004 |
| JP | 2008-018664 | 1/2008 |

(Continued)

*Primary Examiner* — Erica Lin
*Assistant Examiner* — Tracey McMillion
(74) *Attorney, Agent, or Firm* — Cooper & Dunham LLP

(57) ABSTRACT

An inkjet recording method includes forming an image on a coated layer provided at least one side of the substrate of a recording medium with ink containing a colorant; and then applying a post-processing fluid comprising a resin to the image; wherein the application amount per unit area of the post-processing fluid to the image is controlled to be less than the application amount per unit area of the ink to form the image.

15 Claims, 5 Drawing Sheets

(56) References Cited

U.S. PATENT DOCUMENTS

2005/0007431 A1 1/2005 Daly et al.
2005/0054751 A1 3/2005 Namba et al.
2005/0117008 A1 6/2005 Konishi
2005/0168552 A1 8/2005 Arita et al.
2005/0231575 A1 10/2005 Bannai et al.
2006/0176349 A1 8/2006 Nagai et al.
2007/0221078 A1 9/2007 Namba et al.
2008/0012894 A1* 1/2008 Ono ..... B41J 2/2114 347/21
2008/0070008 A1 3/2008 Namba et al.
2008/0138519 A1 6/2008 Habashi et al.
2008/0248260 A1 10/2008 Kojima et al.
2008/0254228 A1 10/2008 Kojima et al.
2008/0302268 A1 12/2008 Arita et al.
2009/0162569 A1 6/2009 Morohoshi et al.
2009/0186162 A1 7/2009 Namba et al.
2009/0239044 A1 9/2009 Habashi et al.
2009/0258196 A1 10/2009 Nagashima et al.
2009/0263632 A1 10/2009 Kojima et al.
2010/0020142 A1 1/2010 Bannai et al.
2010/0112219 A1 5/2010 Yokohama et al.
2010/0196673 A1 8/2010 Nagashima et al.
2010/0227067 A1 9/2010 Namba et al.
2010/0245416 A1 9/2010 Ohshima et al.
2010/0271435 A1 10/2010 Kojima et al.
2010/0279035 A1 11/2010 Namba et al.
2010/0302326 A1 12/2010 Morohoshi et al.
2011/0092610 A1 4/2011 Habashi et al.
2011/0164086 A1 7/2011 Ggoto et al.
2011/0169889 A1 7/2011 Kojima et al.
2011/0205288 A1 8/2011 Matsuyama et al.
2011/0216123 A1 9/2011 Tamai et al.
2011/0300353 A1 12/2011 Habashi et al.
2011/0310166 A1 12/2011 Namba et al.
2011/0316947 A1 12/2011 Kojima et al.
2012/0121831 A1 5/2012 Kudoh et al.
2012/0128949 A1* 5/2012 Goto ..... 428/207
2012/0133702 A1 5/2012 Kojima
2012/0133703 A1 5/2012 Kojima
2012/0236066 A1 9/2012 Tamai et al.
2012/0320133 A1 12/2012 Namba et al.
2012/0328853 A1 12/2012 Matsuyama et al.
2013/0002776 A1 1/2013 Nagashima et al.
2013/0021406 A1* 1/2013 Stoeva ..... C08G 18/0823 347/20
2013/0113860 A1 5/2013 Gotou et al.
2013/0194345 A1 8/2013 Tamai et al.
2013/0201252 A1* 8/2013 Namba ..... C09D 5/00 347/21
2013/0242009 A1 9/2013 Bannai et al.
2013/0293617 A1* 11/2013 Suzuki ..... B41J 11/002 347/16
2013/0307912 A1 11/2013 Masuda et al.

FOREIGN PATENT DOCUMENTS

JP 2011-063016 3/2011
JP 2011-105900 6/2011

* cited by examiner

INKJET RECORDING METHOD AND INKJET RECORDING DEVICE

CROSS-REFERENCE TO RELATED APPLICATIONS

This patent application is based on and claims priority pursuant to 35 U.S.C. §119 to Japanese Patent Application Nos. 2013-002293 and 2013-267185, filed on Jan. 10, 2013 and Dec. 25, 2013, respectively, in the Japan Patent Office, the entire disclosures of which are hereby incorporated by reference herein.

BACKGROUND

1. Technical Field

The present invention relates to an inkjet recording method and an inkjet recording device.

2. Background Art

As inkjet ink, dye ink has been mainly used in terms of coloring and reliability. However, at the same time, such a dye ink has disadvantages about water-resistance, light resistance, etc. For this reason, pigment ink has become popular as a substitute recently.

However, since pigment ink is attached to the uppermost surface of a printed matter (hereinafter referred to as pigment ink printed matter) on which texts and/or images are printed by using pigment ink, the texts and images are easily peeled off, meaning that the friction resistance of the pigment ink printed matter is inferior.

In attempts to improve the friction resistance of such a pigment ink printed matter, for example, JP-2011-63016-A and JP-2011-105900-A disclose methods of protecting (fixing) the surface of a printed matter by discharging transparent post-processing fluid onto a recorded portion of pigment ink to form a film which covers the recorded portion.

However, since a typical image forming method applies such transparent ink to all over the recorded portion, the quality of images deteriorates by transfer contamination to a transfer roller in a high-speed printing system in particular. Moreover, printed continuous paper is reeled again after printing, which causes attachment of contact surfaces of the paper (so-called blocking phenomenon).

Currently, the quality of images on a par with conventional offset printing is in demand to such an inkjet ink recording method even for coated paper having low ink absorption for use in commercial printing. However, since such coated paper has a surface structure not suitable to absorb ink, the quality of images tends to be bad and blocking phenomenon easily occurs due to transfer contamination.

Moreover, JP-4066338-B1 (JP-2004-181688-A) discloses a recording method of changing the amount of overcoat applied to an image after image forming. In this method, yellow ink is overcoat to prevent bronzing and improve the color reproducibility but not to reduce transfer contamination or improve blocking resistance.

In addition, JP-2008-18664-A discloses an inkjet recording method of applying processing fluid after ink is applied, in which the application amounts of the ink and the processing fluid are reduced for duplex printing relative to simplex printing and the reduction rate of the processing fluid is larger than that of the ink.

However, this is to prevent strike-through of images printed on plain paper but not used for coated paper having a low absorption of ink for use in commercial printing.

SUMMARY

The present invention provides an improved inkjet recording method that includes forming an image on a coated layer provided at least one side of the substrate of a recording medium with ink containing a colorant; and then applying a post-processing fluid comprising a resin to the image; wherein the application amount per unit area of the post-processing fluid to the image is controlled to be less than the application amount per unit area of the ink to form the image.

BRIEF DESCRIPTION OF THE DRAWINGS

Various other objects, features and attendant advantages of the present invention will be more fully appreciated as the same become better understood from the detailed description when considered in connection with the accompanying drawings, in which like reference characters designate like corresponding parts throughout and wherein.

DETAILED DESCRIPTION

The present invention is to prevent degradation of the quality of images ascribable to transfer contamination of post-processing fluid and ink and improve blocking resistance.

As a result of the investigation made by the present inventors, it was found that transfer contamination of post-processing fluid and ink was prevented and blocking resistance was improved by setting the application amount of post-processing fluid per unit area less than the application amount of ink per unit area applied to form images instead of coating the entire area of the image with the post-processing fluid.

Inkjet Recording Method

The polymerizable inkjet ink of the present disclosure is described in detail.

In the inkjet recording method of the present disclosure, post-processing fluid is applied after an image is formed by ink and the application amount per unit of area of the post-processing fluid is controlled to be less than that of the ink applied to form an image.

By controlling the application amount of the post-processing fluid to be less than that of the ink, the quality of images printed on coated paper for commercial printing that has a surface structure not suitable to absorb ink is not worsened even at high speed printing because transfer contamination does not occur to transfer members, etc.

The application amount of the post-processing fluid is preferably from 5% by volume to 30% by volume of the application amount of ink. When the application amount of the post-processing fluid is 5% by weight or more, blocking resistance becomes excellent. When the application amount of the application amount of the post-processing fluid is 30% by weight or less, recording is conducted with excellent drying, thereby preventing transfer contamination, resulting in production of quality of images.

It is preferable to apply such post-processing fluid by inkjet recording. The application amount of the post-processing fluid can be controlled by changing the number of droplets or the weight of a droplet of the post-processing fluid discharged from nozzles.

With regard to thermal inkjet, it is difficult to change the vapor foam size, i.e., the discharged ink droplet size, by driving waveform or applied energy to a heating element. For this reason, to discharge ink droplets having different sizes, it is necessary to arrange and select multiple heating elements in one fluid path or arrange nozzles or fluid paths having different dimensions in a recording head.

On the other hand, piezoelectric inkjet can control the position of meniscus by a driving waveform to discharge ink droplets having largely different sizes. In addition, using high response of piezoelectric elements, ink droplets can be discharged continuously at high frequencies to merge ink droplets while their moving in the air or overlap ink droplets on a recording medium, thereby changing the diameters of dots on the medium diameters. For this reason, piezoelectric inkjet is preferable.

Figure 1:
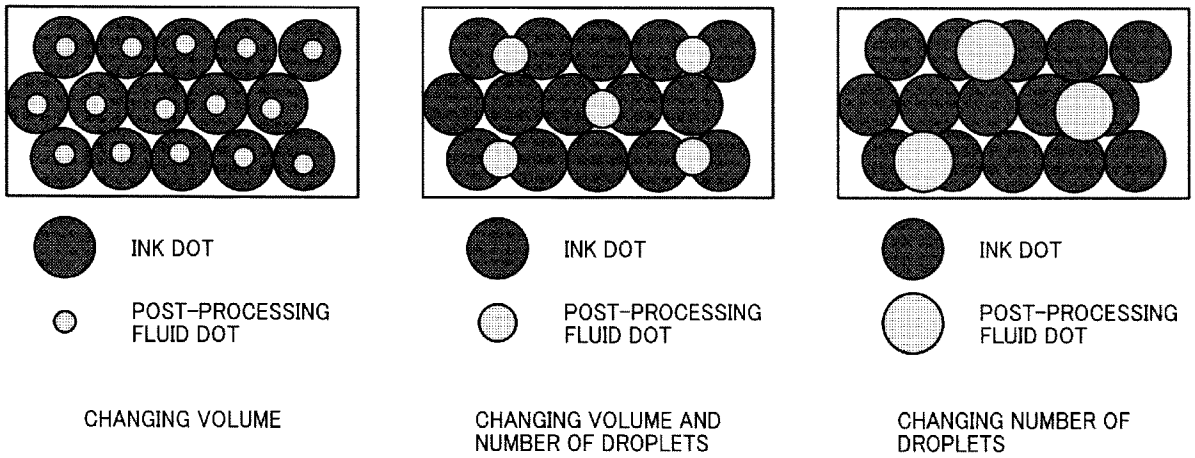
FIG. 1 is a diagram illustrating a state in which ink dots and post-processing fluid are landed on a recording medium by the inkjet recording method according to an embodiment of the present invention.

FIG. 1 is a diagram illustrating a state immediately after the post-processing fluid lands on ink dots. The post-processing fluid spreads to cover an image after landing on a recording medium and forms convex portions on the surface of the image. The convex portions serve as a spacer so that the image is not directly exposed, thereby improving the blocking resistance.

One method of applying the post-processing fluid is that droplets of the post-processing fluid made smaller than those of ink are applied to each of the ink dots formed on a recording medium. Another method is that the droplets of the post-processing fluid having the same size of those of ink that are reduced in numbers are applied. Yet another method is to control both the number and the size of the post-processing fluid droplets. Any of the methods are suitable but, in terms of application of the post-processing fluid, the first method of applying processing liquid having smaller sizes to ink dots is preferable.

Figure 2:
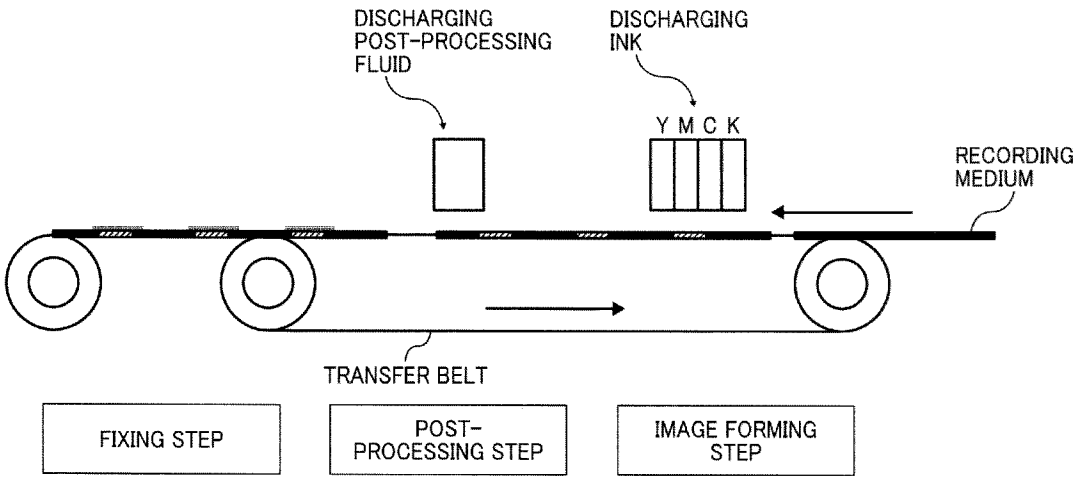
FIG. 2 is a schematic diagram illustrating an example of an ink jet recording device using the inkjet recording method of the present disclosure according to an embodiment of the present invention.

FIG. 2 is a schematic diagram illustrating an example of an ink jet recording device to conduct the inkjet recording method of the present disclosure. A recording medium is conveyed by a conveyor belt. In the image forming process, ink is discharged from inkjet nozzles to form an image on the recording medium. In the post-processing process, the post-processing fluid is applied to an image formed on a recording medium followed by drying and fixing.

Figure 3:
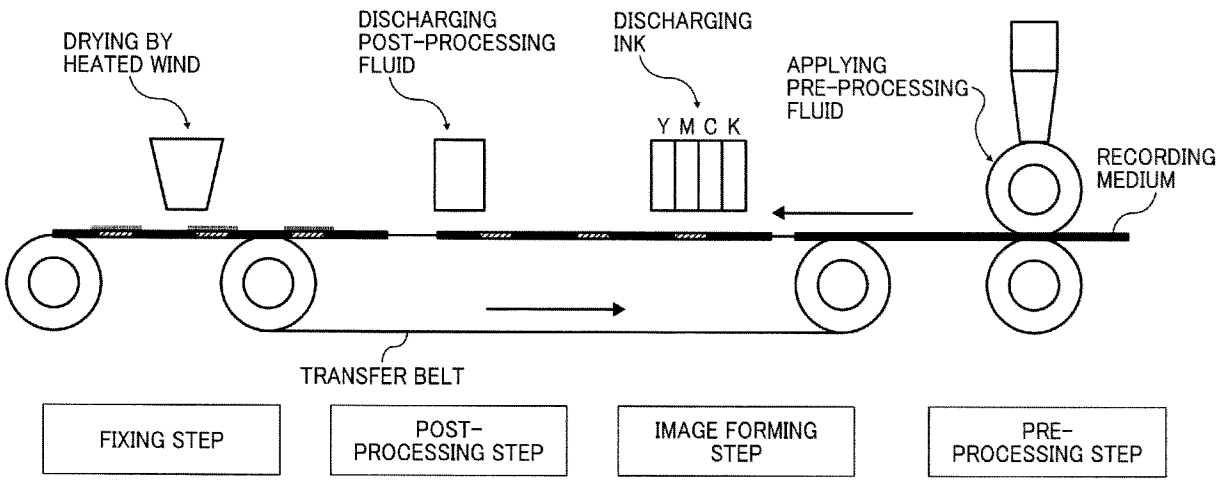
FIG. 3 is a schematic diagram illustrating an example of an ink jet recording device using the inkjet recording method of the present disclosure according to an embodiment of the present invention.

FIG. 3 is a schematic diagram illustrating another example of an ink jet recording device to conduct the inkjet recording method of the present disclosure. The inkjet recording method of the present disclosure optionally includes a process of applying a pre-processing fluid that agglomerates and thickens ink to improve the fixability of the ink to a recording medium.

Any of known application devices can be used to conduct the application of the pre-processing fluid. A method of using a roller is preferable to coat the entire of a recording medium in particular. Controlling the application amount is easy using a roller. By such a roller application, the entire of a recording medium can be uniformly covered with a small amount of pre-processing fluid having a high concentration and viscosity.

In addition, drying by heated wind can be used in the fixing process. Transfer contamination to transfer members can be prevented by drying by heated wind.

Processing Fluid

The post-processing fluid of the present disclosure prevents transfer contamination during transfer of a recording medium and blocking of recording media. The fluid contains a resin, water, a hydrosoluble organic solvent, a surface active agent, and optional other components such as wax.

Urethane resins, acrylic resins, styrene-acrylic resins, etc. can be used as the resin. Urethane resins are preferable in particular in terms of forming a film having a high surface hardness, reducing transfer contamination to transfer members, and improving blocking resistance.

In particular, resin emulsions containing a urethane resin and a vinyl polymer formed by entangling the molecular chains of the urethane resin and the vinyl polymer have excellent dispersion stability without agglomeration and forms thin uniform film on an image after the droplet of the post-processing fluid has landed. For this reason, a small amount of this resin emulsion forms a film having a high hardness with no tucking, which improves fixability and the friction resistance and the blocking resistance of print products.

The resin emulsion containing the urethane resin and the vinyl polymer are prepared by dispersing a neutralized material of a urethane prepolymer having carboxyl groups with isocyanate groups at their ends and a vinyl monomer in water to polymerize the vinyl monomer and thereafter extending the chain of the urethane prepolymer.

The urethane prepolymer is obtained by reacting a diol component and a diisocyanate compound with a ratio in which the organic diisocyanate component is chemically excessive to the diol component.

As the organic dissocyanate component, variety of aliphatic, alicyclic, aromatic diisocyanate compounds for use in preparation of typical urethane prepolymers can be selected.

Specific examples of the isocyanating agents include, but are not limited to, dicyclohexyl methane diisocyanate, 1,6-hexamethylene didsocyanate, isophorone diisocyanate, 1,3-cyclohexylene diisocyanate, 1,4-cyclohexylene diisocyanate, 2,4-tolylene diisocyanate, 2,6-tolylene diisocyanate, 4,4'-diphenyl methane diisocyanate, 2,4'-diphenyl methane diisocyanate, and 2,2'-diphenyl methane diisocyanate.

Specific examples of the diol component include, but are not limited to, diols having relatively small molecular weights such as ethylene glycol, propylene glycol, 1,3-propane diol, 1,3-butane diol, 1,4-butane diol, 1,5-pentan diol, 3-methyl-1,5-pentane diol, 1,6-hexane diol, neopentyl glycol, diethylene glycol, trimethylene glycol, triethylene glycol, tetraethylene glycol, dipropylene glycol, tripropylene glycol, and cyclohexane dimethanol; and polyester diol, polyether diol, and polycarbonate diol.

The thus-obtained urethane prepolymer contains a carboxyl group. To introduce a carboxyl group into the urethane prepolymer, it is preferable to use dimethylol alkane acid as part of the diol component. Specific examples of dimethylol alkane acid include, but are not limited to, dimethylol propionic acid and dimethylol butanic acid.

The acid value of the urethane prepolymer preferably ranges from about 15 to about 60, more preferably from about 15 to about 50, and furthermore preferably from about 18 to about 50. When the acid value of the urethane prepolymer is too small, the dispersion state in water in the post process tends to deteriorate, thereby failing to obtain an aqueous liquid dispersion.

The acid value of the urethane prepolymer s adjusted by the amount of dimethylol alkane acid.

To obtain the aqueous dispersible urethane prepolymer, carboxylic acid groups in the urethane prepolymer are neutralized.

Specific examples of the neutralizing agent for use in the neutralization include, but are not limited to, tertiary amine compounds including trimethyl amine, triethyl amine, and tributyl amine.

As the chain extending agent, any of known chain extending agent having an active hydrogen is suitably used. Specific examples of the chain extending agent include, but are not limited to, diamines such as ethylene diamine, hexamethylene diamine, cyclohexane diamine, cyclohexyl methane diamine, and isophorone diamine; and hydradine.

The number average molecular weight of the urethane resin preferably ranges from 1,000 to 300,000.

The vinyl monomer is non-reactive to an isocyanate group. Specific examples thereof include, but are not limited to, lower alkyl esters having one to eight carbon atoms such as acrylic acid and methacrylic acid, styrene, vinyl acetate, vinyl acrylate, and vinyl methacrylate.

As a radical initiator to start polymerization reaction of a vinyl monomer, conventional radical initiators are suitably used. For example, azo-based initiators, persulfate-based initiators, and peroxide-based initiators can be used. Redox products such as a peroxide-based initiator and ascorbic acid or rongalite or a persulfate-based initiator and a metal sulfite are preferable.

The content of such a radical initiator is from about 0.1% by weight to about 5% by weight and preferably from about 0.5% by weight to about 2% by weight to the vinyl monomer.

The number average molecular weight of the vinyl polymer preferably ranges from 10,000 to 1,000,000.

The ratio of the urethane prepolymer to the vinyl monomer can be adjusted to a particular application. Preferably, the ratio (mass ratio of solid portion) of the urethane prepolymer to the vinyl monomer is from 10:90 to 90:10.

The average particle diameter of the resin emulsion containing the polyurethane and the vinyl polymer in the post-processing fluid preferably ranges from 50 nm to 300 nm. When the average particle diameter is too small, the viscosity of the post-processing fluid tends to be high. When the average particle diameter is too large, the application amount tends to be excessive.

As the resin emulsion containing the polyurethane and the vinyl polymer, products on market such as SU-100 (manufactured by CHIRIKA. Co., ltd.) can be used.

The glass transition temperature of the resin is −30° C. or higher and the minimum film forming temperature (MFT) thereof is 50° C. or lower. When the glass transition temperature is too low, the resin layer tends to be too viscous, thereby forming tuck on a printed matter. When the glass transition temperature is too high, a layer is not formed in a short time even using a drying device such as a heater or heated wind, which makes it unsuitable in terms of practical use.

The glass transition temperature of the resin can be measured by a thermo-mechanical analysis (TMA) method, a differential scanning calorimetry (DSC) method, or a dynamic mechanical analysis (DMA) method (tensile testing). The minimum film forming temperature of the aqueous dispersion resin can be measured by, for example, a minimum film forming temperature measuring instrument (MFT type).

The content of the resin depends on the kind thereof and a particular application but preferably ranges from 3% by weight to 10% by weight to the total amount of post-processing fluid and more preferably ranges from 5% by weight to 10% by weight.

When the content is 3% by weight or more, good friction resistance is obtained and when the content is 10% by weight or less, good friction resistance and blocking resistance become excellent.

Hydrosoluble Organic Solvent

The post-processing fluid for use in the present disclosure optionally contains a hydrosoluble organic solvent to prevent clogging of a recording head nozzle ascribable to natural drying, improve wettability with a recording medium, and adjust the permeation speed of the post-processing fluid.

Specific example of the hydrosoluble organic solvent mainly serving as a wetting agent to prevent clogging of a recording head nozzle include, but are not limited to, polyols such as ethylene glycol, diethylene glycol, triethylene glycol, tetraethylene glycol, polyethylene glycol, propylene glycol, 1,3-butane diol, 1,3-propane diol, 2-methyl-1,3-propane diol, 1,4-butane diol, 1,5-pentane diol, 1,6-hexane diol, glycerin, 1,2,6-hexane triol, 2-ethyl-1,3-hexane diol, 1,2,4-butane triol, 1,2,3-butane triol, and petriol; polyol alkyl ethers such as ethylene glycol monoethyl ether, ethylene glycol monobutyl ether, diethylene glycol monometyl ether, diethylene glycol monoetyl ether, diethylene glycol monobutyl ether, triethylene glycol monobutyl ether, tetraethylene glycol monomethyl ether, and propylene glycol monoethyl ether; polyol aryl ethers such as ethylene glycol monophenyl ether, and ethylene glycol monobenzyl ether; nitrogen-containing heterocyclic compounds such as N-methyl-2-pyrolidone, N-hydroxyethyl-2-pyrolidone, 1,3-dimethyl imidazolidinone, and ϵ-caprolactone; amides such as formamide, N-methylformamide, and N,N-dimethylformamide; amines such as monoethanol amine, diethanol amine, triethanol amine, monoethyl amine, diethyl amine, and triethyl amine; sulfur-containing compounds such as dimethyl sulfoxide, sulfolane, and thiodiethanol; propylene carbonate, γ-butyloractone, and ethylene carbonate.

The content of the hydrosoluble organic solvent mainly serving as a wetting agent is preferably from 10% by weight to 50% by weight to the total amount of the post-processing fluid and more preferably from 20% by weight to 35% by weight.

When the content is 10% by weight or more, the nozzle is suitably prevented from drying. When the content is 50% by weight or less, the viscosity of the ink becomes suitable, which leads to good discharging of droplets.

Specific example of the hydrosoluble organic solvent mainly serving as a permeating agent to adjust the wettability with a recording medium include, but are not limited to, alkyls and aryl ethers of polyols such as diethylene glycol monophenyl ether, ethylene glycol monophenyl ether, ethylene glycol monoaryl ether, diethylene glycol monophenyl ether, diethylene glycol monobutyl ether, propylene glycolo monobutyl ether, and tetraethylene glycol chlorophenyl ether; and lower alcohols such as ethanol and 2-propanol. These can be used alone or in combination.

The content of the hydrosoluble organic solvent mainly serving as a penetrating agent is preferably from 0.1% by weight to 20% by weight to the total amount of the post-processing fluid and more preferably from 5% by weight to 10% by weight.

When the total amount of the liquid components at 25° C. which have boiling points higher than that of water is 20% by weight or less and preferably 15% by weight or less.

Surface Active Agent

The post-processing fluid for use in the present disclosure optionally contains a surface active agent to improve the wettability and permeability with a recording medium by decreasing surface tension, thereby quickly forming a particulate layer.

As the surface active agents, for example, anionic surface active agents, cationic surface active agents, nonionic surface active agents, amphoteric surface active agents, and fluorine-containing or silicone-containing surface active agents can be used.

The content of the surface active agent is preferably from 0.01% by weight to 3.0% by weight and more preferably from 0.5% by weight to 2% by weight When the content is 0.01% by weight or more, the effect of the surface active agent is suitably demonstrated. When the content is 3.0% by weight or less, the penetration of ink to a recording medium becomes good, thereby producing quality images without a decrease of the image density and occurrence of strike-through.

Specific examples of the other components include, but are not limited to, wax, polymer-modified silicone oil, antiseptic and anti-fungal agents, and pH controlling agents.

Wax

The wax mentioned above improves the friction resistance and the blocking resistance of images by applying the wax to the surface of an image.

Any wax that can be dispersed in water is used. Polyethylene wax emulsion having a melting point of from 120° C. to 140° C. When the melting point is too low, the preservability of the post-processing fluid tends to deteriorate because of agglomeration with the resin particulates. When the melting point is too high, the slipping effect of the wax may deteriorate, which results in degradation of the friction resistance of an image.

The polyethylene wax emulsion preferably has a particle diameter of 0.2 μm or less.

Specific examples of such polyethylene wax emulsion include, but are not limited to, AQUACER-515 (manufactured by BYK Chemie Japan) and POLYRON P-502 (manufactured by CHUKYO YUSHI CO., LTD.)

The content of the wax depends on the kind of wax and particular application but is preferably from 1% by weight to 10% by weight to the total amount of the post-processing fluid, more preferably from 1% by weight to 7% by weight, and furthermore preferably from 1% by weight to 5% by weight.

Polyether-Modified Silicone Oil

The post-processing fluid optionally contains polyether-modified silicone oil having a slipping property to improve friction resistance and blocking resistance of an image.

The polyether-modified silicone oil is prepared by introducing a polyether group to the side chain, the end, or both of silicone oil.

Silicone oil is formed of linear polymers formed of siloxane bonds. Specific examples of the linear polymer formed of siloxane bonds include, but are not limited to, linear polymers having side chains and both ends only formed of methyl groups. The average polymerization degree of linear polymers formed of siloxane bonds is from 45 to 230.

The content of the polyether-modified silicone oil is preferably from 0.1% by weight to 5.0% by weight, more preferably from 0.5% by weight to 3% by weight, and furthermore preferably from 1% by weight to 1.5% by weight.

Specific products of both end polyester-modified silicone oil having a polydimethyl siloxane main chain include, but are not limited to, BYK-333 and BYK-3500 (manufactured by BYK Chemie JAPAN).

Anti-Septic and Anti-Fungus Agent

The post-processing fluid optionally contains an anti-septic and anti-fungal agent to improve preservability and image quality stability.

Specific examples of the anti-septic and anti-fungus agents include, but are not limited, dehydrosodium acetate, sodium sorbinate, 2-pyridine thiol-1-oxide sodium, isothiazoline-based compounds, sodium benzoate, and pentachlorophenol sodium.

The content of the anti-septic and anti-fungus agent is preferably from 0.01% by weight to 3.0% by weight to the total amount of post-processing fluid and more preferably from 0.5% by weight to 2% by weight.

Anti-Corrosion Agent

The post-processing fluid optionally contains an anti-corrosion agent to prevent corrosion of the metal surface such as a head that contacts the post processing fluid.

Specific examples of the anti-corrosion agents include, but are not limited to, benzotriazol, acid sulfite, thiosodium sulfate, antimony thiodiglycolate, diisopropyl ammonium nitrite, pentaerythritol quaternary nitride, and dicyclohexyl ammonium nitrite.

The content of the anti-corrosion agent is preferably from 0.01% by weight to 3.0% by weight to the total amount of post-processing fluid and more preferably from 0.5% by weight to 2% by weight.

pH Controlling Agent

The post-processing fluid for use in the present disclosure optionally contains a pH controlling agent.

Specific examples thereof include, but are not limited to, hydroxides of alkali metal elements such as lithium hydroxide, sodium hydroxide, and potassium hydroxide; ammonium hydroxide, hydroxides of quaternary-ammonium, hydroxides of quaternary phosphonium, carbonates of alkali metals such as lithium carbonate, sodium carbonate, and potassium carbonate; amines such as diethanol amine and triethanol amine; acidum boricum, hydrochloric acid, nitric acid, sulfuric acid, and acetic acid.

The content of the pH controlling agent is preferably from 0.01% by weight to 3.0% by weight to the total amount of post-processing fluid and more preferably from 0.5% by weight to 2% by weight.

It is preferable to adjust the viscosity and the surface tension of the post-processing fluid to spread dots widely after the fluid lands on a recording medium.

The post-processing fluid for use in the present disclosure preferably has a static surface tension of from 10 mN/m to 35 mN/m at 25° C. and more preferably from 15 mN/m to 30 mN/m. When the static surface tension is 35 mN/m or less, the post-processing fluid suitably spreads on an image, thereby providing a recording method capable of quick dry for a short time.

The post-processing fluid preferably has a viscosity of from 1.2 mPa·s to 15 mPa·s, more preferably from 1.5 mPa·s to 10 mPa·s, and furthermore preferably from 1.8 mPa·s to 8 mPa·s. When the viscosity of the post-processing fluid is 15 mPa·s or less, the post-processing fluid suitably spreads on an image, thereby ameliorating blocking resistance. When the viscosity of the post-processing fluid is 1.2 mPa·s or more, the discharging stability of the post-processing fluid is increased.

Ink

The ink for use in the present disclosure is applied to the coated side of a recording medium to form an image thereon and contains a coloring agent, water, a hydrosoluble organic solvent, a surface active agent, and optional agents such as an anti-septic and anti fungus agent, an anti-corrosion agent, and a pH controlling agent.

Coloring Agent

Pigments, self-dispersible pigments, resin coating pigment can be used as the coloring agent. Both organic pigments and inorganic pigments are suitable.

Specific examples of the organic pigments include, but are not limited to, phthalocyanine-based pigments, quinacridone-based pigments, azo-based pigments, anthraquinone-based pigments, dioxazine-based pigments, indigo-based pigments, thio-indigo-based pigments, perylene-based pigments, isoindolinone-based pigments, aniline black, azomethine-based pigments, carbon black, and rhodamine B lake pigments.

Specific examples of the inorganic pigments include, but are not limited to, titanium oxide, iron oxide, calcium carbonate, barium sulfate, aluminum hydroxide, barium yellow, indigo, cadmium red, chrome yellow, and metal powder.

Specific examples of black pigments include, but are not limited to, No. 2300, No. 900, MCF88, No. 40, No. 52, MA7, and MA8, No. 2200B (manufactured by Mitsubishi Chemical Corporation), RAVEN1255 (manufactured by Columbian Chemicals Company), REGAL400R, REGAL 660R, and MOGUL L (manufactured by Cabot Corporation), Color Black FW1, Color Black FW18, Color Black S170, Color Black S150, Printex 35, and Printex U (manufactured by Degussa AG).

The content of the coloring agent in ink is preferably from 2 percent by weight to 12 percent by weight and more preferably from 4 percent by weight to 8 percent by weight to the total amount of the ink.

When the content of the coloring agent is 2% by weight or more, the density of an image becomes suitable, thereby producing quality images without feathering or oozing. When the content of the coloring agent is 12% by weight or less, the ink in a nozzle is prevented from becoming more viscous when a recording device is left undone, resulting in good ink discharging. In addition, since the ink has a suitable viscosity, the ink has a good permeability and dots suitably spread, resulting in production of quality images with suitable image density.

The same hydrosoluble organic solvent, the surface active agent, the anti-septic and anti-fungus agent, and the pH control agent as those mentioned above for the post-processing fluid can be used.

Pre-Processing Fluid

The inkjet recording method of the present disclosure optionally contains a pre-processing fluid that agglomerates and thickens ink to improve the fixability of the ink to a recording medium.

If images are formed after processing the surface of a recording medium with the pre-processing fluid, the image density is furthermore improved.

The pre-processing fluid contains pigment agglomerating agents such as polyvalent metal salts, cationic materials, and acids.

Specific examples of the metal ion of the polyvalent metals salts include, but are not limited to, alkali metal ions, divalent metal ions such as Ca, Cu, Ni, Mg, Zn, and Ba, and trivalent metal ions such as Al, Fe, and Cr.

Specific examples of negative ions constituting the polyvalent metal salts include, but are not limited to, ions of organic acids such as citric acid, tartaric acid, acetic acid, lactic acid, oxalic acid, carboxylic acid, fumaric acid, salicylic acid, and benzoic acid; and inorganic ions such as OH, Cl, $NO_3$, I, Br, and $ClO_3$.

Specific examples of the polyvalent metal salts include, but are not limited to, aluminum potassium sulfate, aluminum sulfate, and calcium chloride.

Specific examples of the cationic material include, but are not limited to, polyamines such as dimethyl amine, diethyl amine, dipropyl amine, methyl ethyl amine, methyl propyl amine, methyl butyl amine, methyl octyl amine, methyl lauryl amine, ethylene diamine, diethylene triamine, polyaryl amine, polyethylene imine, piperidine, pyrrol, and carbazole.

As the acid, any of inorganic acids and organic acids can be selected.

Specific examples of the inorganic acid include, but are not limited to, hydrochloric acid, sulfuric acid, sulfurous acid, nitric acid, nitrous acid, phorphpric acid, acidum boricumm and carbonic acid. Specific examples of the organic acid include, but are not limited to, carboxylic acid, sulphonic acid, and amino acid. Acids having a first dissociation constant pKa of 5 or less in water are preferable.

Specific examples of such acids having a first dissociation constant pKa of 5 or less include, but are not limited to, hydrochloric acid, nitric acid, sulfuric acid, phosphoric acid, acetic acid, formic acid, oxalic acid, lactic acid, citric acid, maleic acid, and maronic aid.

The content of the agglomerating agents added to the pre-treatment agent ranges from 0.1% by weight to 40% by weight to the total amount of the pre-processing fluid, preferably from 1% by weight to 30% by weight, and more preferably from 3% by weight to 15% by weight to prevent increase of viscosity of agglomeration and precipitation around nozzles of heads.

Optionally, resins, hydrosoluble organic solvents, surface active agents, pH controlling agents, anti-septic and anti-fungus agents, anti-corrosion agents, etc. can be added to the pre-processing fluid. The same additives as those for the post-processing fluid can be used.

Recording Media

The recording medium for use in the inkjet recording method of the present disclosure has a coated layer to make it look high-grade and also a suitable recording medium can be selected to a particular application. Preferred specific examples thereof include, but are not limited to, general print paper such as coated paper, gloss paper, art paper, and super art paper.

Among these, in terms of recording images having high quality (image density, saturation, beading, color bleed) and high gloss with excellent smear fixability, general printing paper having a liquid imbibition in a particular range is preferable. Specifically, printing paper is used which has a transfer amount of pure water to a recording medium of from 1 ml/m2 to 10 ml/$m^2$ in a contact time of 100 ms as measured by a dynamic scanning absorptometer (DSA).

When the transfer amount of pure water in the contact time of 100 ms is within the range mentioned above, beading (non-uniform density) or color bleed (oozing between colors) never or little occurs. Moreover, the ink dot diameter after recording is suitable, thereby producing good solid images.

This dynamic scanning absorptometer (Journal of JAPAN TAPPI, Vol. 48, p 88 to p 92, published in May 1994, authored by Shigenori Kuga) can measure accurately the imbibition liquid amount in an extremely small amount. Measuring is automated in this dynamic scanning absorptometer by the method of: (1) directly reading the absorption speed of liquid from moving of meniscus in a capillary; and (2) spirally scanning a sample having a disc-like form with an imbibition head, while automatically changing the scanning speed according to predetermined patterns to measure the necessary number of points of the single sample.

The liquid supply head to paper sample is connected to the capillary via a TEFLON® tube and the position of the meniscus in the capillary is automatically read by an optical sensor. Specifically, the transfer amount of pure water is measured using a dynamic scanning absorptometer (K350 Series D type, manufactured by Kyowa Seiko Inc.). The transfer amount in the contact time of 100 ms is obtained by interpolation from the measuring result of the transfer amount in the proximity contact time of the contact time.

Printing paper having a liquid imbibition in a particular range is available on market. Specific examples thereof include, but are not limited to, RICOH BUISINESS COAT GLOSS 100 (manufactured by RICOH Co., Ltd.), OK TOP COAT+, OK KINFUJI+, and SA KINFUJI+ (manufactured by Oji Paper Co., Ltd.), SUPER MI DUL, AURORA COAT, and SPACE DX (manufactured by Nippon Paper Industries Co., Ltd.), α matte and μ coat (manufactured by Hoketsu Paper Co., Ltd.), RAICHO ART and RAICHO SUPER ART (manufactured by Chuetsu Pulp & Paper Co., Ltd.), and PEARL COAT N (manufactured by Mitsubishi Paper Mills Limited).

Inkjet Recording Device

Figure 4:
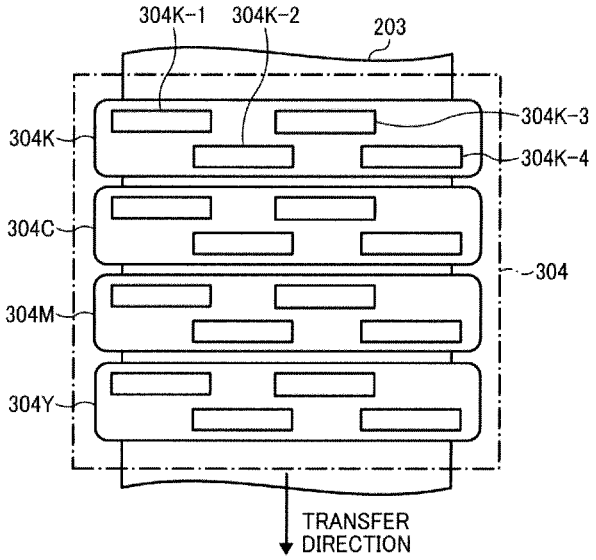
FIG. 4 is a diagram illustrating an example of the ink droplet discharging head of the inkjet recording device according to an embodiment of the present invention.

FIG. 4 is a diagram illustrating an example of the ink droplet discharging head of the inkjet recording device of the present disclosure.

Figure 5:
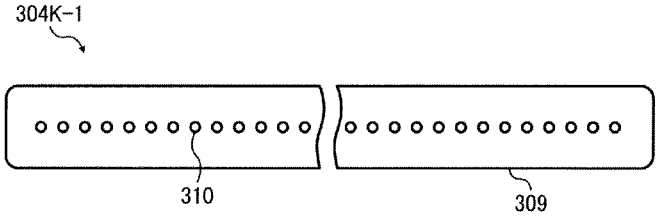
FIG. 5 is an enlarged view illustrating the head unit of the ink droplet discharging head illustrated in FIG. 4.

An image forming processing unit 304 is a full-line type head including four recording heads 304K, 304C, 304M, and 304Y of black (K), cyan (C), magenta (M), and yellow (Y), respectively, arranged in this order relative to the transfer direction of a recording medium. For example, the recording head 304K has four short head units of 304K-1, 304K-2, 304K-3, and 304K-4 arranged zig-zag along the transfer direction of the recording medium as illustrated in FIG. 4 to secure the print area width. FIG. 5 is an enlarged view illustrating the head unit 304K-1. As illustrated in FIG. 5, a nozzle surface 309 of the head unit 304K1 has multiple print nozzles 310 arranged along longitudinal direction of the head unit 304K-1 to form a nozzle line. In this embodiment, there is only one nozzle line but multiple nozzle lines can be arranged. The other heads 304C, 304M, and 304Y have similar constitutions and the four recording heads 304K, 304C, 304M, and 304Y have the same gap therebetween arranged along the transfer direction. Therefore, an image can be formed in the entire printing area by a single image forming operation.

Figure 6:
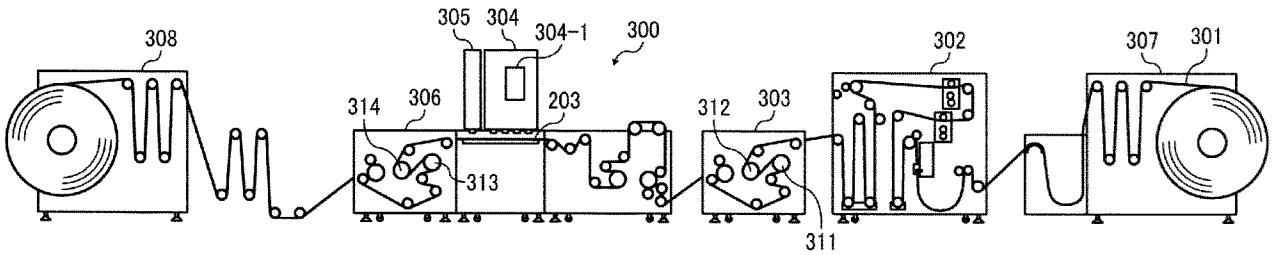
FIG. 6 is a schematic diagram illustrating an inkjet recording device to which the present disclosure is applied.

FIG. 6 is a schematic diagram illustrating an example of the entire of the image forming apparatus of the present disclosure.

FIG. 6 is a schematic diagram illustrating an inkjet recording device to which the present disclosure is applied. An inkjet recording device 300 to which the present disclosure is applied includes a recording medium transfer unit 301, a pre-processing unit 302 to apply a pre-processing fluid to a recording medium 203, a post-pre-processing drying unit 303 to dry the recording medium to which the pre-processing fluid is applied, the image forming processing unit 304 including an ink container 304-1 to form an image on the recording medium 203, a post-processing unit (post-processing fluid supplying device) 305 to apply a post-processing fluid to the recording medium 203 after the image is formed thereon, and a post-post-processing drying unit 306 to dry the recording medium 203 to which the post-processing fluid is applied.

A recording medium transfer unit 301 has a sheet feeder 307, multiple transfer rollers, and a reeling unit 308. The recording medium 203 is continuous roll paper, reeled out from the sheet feeder 307 by the transfer rollers, transferred along on a platen glass, and reeled up by a reeling device. The recording medium 203 transferred from the recording medium transfer unit 301 is coated with the pre-processing fluid at the pre-processing unit 302 of FIG. 6. If an image is formed on a recording medium other than a special inkjet sheet, quality problems about feathering, density, coloring, strike-through, etc. can be avoided and image durability about water-proof, weatherability, etc. are improved by applying the pre-processing fluid having a feature to agglomerate ink to such a recording medium.

Having generally described preferred embodiments of this invention, further understanding can be obtained by reference to certain specific examples, which are provided herein for the purpose of illustration only and are not intended to be limiting. In the descriptions in the following examples, the numbers in parts represent weight ratios in parts unless otherwise specified.

EXAMPLES

The present invention is described in detail with reference to the Examples but not limited to the following Examples.

Manufacturing Example 1

The following recipe was mixed and stirred followed by filtering using a filter to prepare [Post-processing fluid 1].

| | |
|---|---|
| 3-methyl-1,3-butane diol: | 22% by weight |
| Glycerin: | 11% by weight |
| 2-ethyl-1,3-hexane diol: | 2% by weight |
| Fluorine-containing surface active agent (addition reaction product of perfluoroalkyl polyethylene oxide, DSN-403N, manufactured by DAIKIN INDUSTRIES, ltd.): | 0.05% by weight |
| Anti-fungus agent (Proxel GXL manufactured by Arch Chemicals, Inc.): | 0.05% by weight |
| Defoaming agent (EMBIROGEM ® AD-01, manufactured by Nisshin Chemical Co., Ltd.): | 0.1% by weight |
| 2-amino-2-ethyl-1,3-propane diol: | 0.2% by weight |
| Acrylic-modified urethane resin emulsion (40% by weight concentration: effective component amount) (SU-100N, manufactured by CHIRIKA. Co., ltd.): | 6% by weight |
| Polyethylene wax (35% by weight concentration: effective component amount) (oxidized highly concentrated polyethylene wax, ACUACERS 515, manufactured by BYK Chemie Japan): | 5% by weight |
| Polyether-modified polydimethyl siloxane (BYK-333, manufactured by BYK Chemie Japan): | 1% by weight |
| Deionized water: | Rest |

Manufacturing Example 2

[Post-processing fluid 2] was manufactured in the same manner as in [Post-processing fluid 1] except that no polyether-modified polydimethyl siloxane was used.

Manufacturing Example 3

[Post-processing fluid 3] was manufactured in the same manner as in [Post-processing fluid 1] except that no polyetylene wax was used.

Manufacturing Example 4

[Post-processing fluid 4] was manufactured in the same manner as in [Post-processing fluid 1] except that the acrylic-modified urethane emulsion was changed to a styrene-acrylic acid emulsion (MICROGEL E-1002, molecular weight: 50,000, acid value: 130, particle diameter: 75 nm, manufactured by Nippon Paint Co., Ltd.).

Manufacturing Example 5

[Post-processing fluid 5] was manufactured in the same manner as in [Post-processing fluid 1] except that no acrylic-modified urethane resin emulsion was used.

Manufacturing Example 6

[Post-processing fluid 6] was manufactured in the same manner as in [Post-processing fluid 5] except that no polyetylene wax was used.

The recipes of [Post-processing fluid 1] to [Post-processing fluid 6] were shown in Table 1.

TABLE 1

| Post-processing fluid composition | Post-processing fluid 1 (% by weight) | Post-processing fluid 2 (% by weight) | Post-processing fluid 3 (% by weight) | Post-processing fluid 4 (% by weight) | Post-processing fluid 5 (% by weight) | Post-processing fluid 6 (% by weight) |
|---|---|---|---|---|---|---|
| 3-methyl-1,3-butane-diol | 22 | 22 | 22 | 22 | 22 | 22 |
| Glycerin | 11 | 11 | 11 | 11 | 11 | 11 |
| 2-ethyl-1,3-hexane diol | 2 | 2 | 2 | 2 | 2 | 2 |
| Fluorine-containing surface active agent | 0.05 | 0.05 | 0.05 | 0.05 | 0.05 | 0.05 |
| Anti-fungus agent | 0.1 | 0.1 | 0.1 | 0.1 | 0.1 | 0.1 |
| Defoaming agent | 0.2 | 0.2 | 0.2 | 0.2 | 0.2 | 0.2 |
| Acrylic-modified urethane resin emulsion | 6 | 6 | 6 | 0 | 0 | 0 |
| Styrene-acrylic acid emulsion | 0 | 0 | 0 | 6 | 0 | 0 |
| Polyethylene wax | 5 | 5 | 0 | 5 | 5 | 0 |
| Polyether-modified polydimethyl siloxane | 1 | 0 | 1 | 1 | 1 | 1 |
| Deionized water | Rest | Rest | Rest | Rest | Rest | Rest |

Manufacturing Example 7

The following recipe was mixed and stirred followed by filtering using a filter to prepare [Pre-processing fluid A].

| | |
|---|---|
| 1,3-butane diol: | 10% by weight |
| L-lactic acid: | 15% by weight |
| 2-amino-2-methyl-1,3-propane diol: | 0.1% by weight |
| N,N-diethyl ethanol amine: | 23.42% by weight |
| Calcium lactate: | 5.0% by weight |
| Surface active agent (FUTARGENT 251, Rf-O-polyoxyethylene ether, manufactured by NEOS COMPANY LIMITED): | 0.1% by weight |
| Surface active agent (modified silicone oil: KF643, manufactured by Shin-Etsu Chemical Company Limited): | 1% by weight |
| Anti-fungus agent (Proxel GXL manufactured by Arch Chemicals, Inc.): | 0.05% by weight |
| 1,2,3-Benzotriazole: | 0.1% by weight |
| Deionized water: | Rest |

Manufacturing Example 8

Manufacturing of Black Ink 1

Preparation of Polymer Solution

After sufficient replacement with nitrogen gas in a flask equipped with a mechanical stirrer, a thermometer, a nitrogen gas introducing tube, a reflux tube, and a dripping funnel, 11.2 g of styrene, 2.8 g of acrylic acid, 12.0 g of lauryl methacrylate, 4.0 g of polyethylene glycol methacrylate, 4.0 g of styrene macromer, 0.4 g of mercapto ethanol, and 40 g of methylethyl ketone were mixed and heated to 65° C.;

Next, a liquid mixture of 100.8 g of styrene, 25.2 g of acrylic acid, 108.0 g of lauryl methacrylate, 36.0 g of polyethylene glycol methacrylate, 60.0 g of hydroxyethyl methacrylate, 36.0 g of styrene macromer, 3.6 g of mercapto ethanol, 2.4 g of azobisdimethyl valeronitrile, and 342 g of methylethyl ketone was dropped into the flask in two and a half hours.

Subsequently, a liquid mixture of 0.8 g of azobis methyl valeronitrile and 18 g of methylethyl ketone was dropped into the flask in half an hour. After one-hour aging at 65° C., 0.8 g of azobismethyl valeronitrile was added followed by further one-hour aging. After the reaction, 800 g of [Polymer Solution] having a concentration of 50% by weight was obtained.

Preparation of Aqueous Dispersion Element 1 of Polymer Containing Black Pigment 28 g of the [Polymer Solution], 32 g of black pigment (C. I. Pigment Black 7: Monarch 880, manufactured by Cabot Corporation), 13.6 g of 1 mol/L potassium hydroxide aqueous solution, 20 g of methylethyl ketone, 13.6 g of deionized water were sufficiently stirred followed by kneading by a roll mill.

The thus-obtained paste was placed in 200 g of pure water; Subsequent to sufficient stirring, methylethyl ketone and water were distilled away using an evaporator to obtain an [Aqueous dispersion element 1 of polymer containing black pigment] having a pigment of 15% by weight and a solid portion of 20% by weight.

Preparation of Ink

The liquid mixture having the following recipe was stirred for an hour to mix uniformly. 33% by weight of the [Aqueous dispersion element 1 of polymer containing black pigment] was added thereto and deionized water was added such that the total was 100% by weight followed by stirring for an hour.

Thereafter, the resultant was filtered by 0.8μ cellulose acetate membrane filter with an increased pressure to remove coarse particles, thereby obtaining [Black Ink 1].

| | |
|---|---|
| Fluorine-containing surface active agent (addition reaction product of perfluoroalkyl polyethylene oxide, DS-403N, manufactured by DAIKIN INDUSTRIES, ltd.): | 0.1 parts |
| Wetting agent (1,3-butane dial) (BD): | 20 parts |
| Wetting agent (glycerin) (Gly): | 10 parts |
| Wetting agent (2-ethyl-1,3-hexane diol) (EHD): | 2 parts |
| Defoaming agent (2,4,7,9-tetramethyl-4,7-daceane diol) (AD-01, manufactured by Nisshin Chemical Co., Ltd.): | 0.2 parts |

Manufacturing Example 9

Preparation of Cyan Ink

Preparation of Cyan Pigment Containing Dispersion Element 2

[Aqueous dispersion element 2 of polymer containing cyan pigment] having a pigment amount of 15% by weight and a solid portion of 20% by weight was prepared in the same manner as in [Aqueous dispersion element 1 of polymer containing black pigment] except that the pigment was changed to C.I. Pigment Blue 15:3

Preparation of Ink

[Cyan ink 1] was prepared in the same manner as in [Black ink 1] except that [Aqueous dispersion element 2 of polymer containing cyan pigment] mentioned above was used in an amount of 28% by weight.

Manufacturing Example 10

Preparation of Magenta Ink

Preparation of Aqueous Dispersion Element 3 of Polymer Containing Magenta Pigment

[Aqueous dispersion element 3 of polymer containing magenta pigment] having a pigment amount of 15% by weight and a solid portion of 20% by weight was prepared in the same manner as in [Aqueous dispersion element 1 of polymer containing black pigment] except that the pigment was changed to C.I. Pigment Red 122.

Preparation of Ink

[Magenta ink 1] was prepared in the same manner as in [Black ink 1] except that [Aqueous dispersion element 3 of polymer containing magenta pigment] mentioned above was used in an amount of 32% by weight.

Manufacturing Example 11

Yellow Ink

Preparation of Aqueous Dispersion Element 4 of Polymer Containing Yellow Pigment

[Aqueous dispersion element 4 of polymer containing yellow pigment] having a pigment amount of 15% by weight and a solid portion of 20% by weight was prepared in the same manner as in [Aqueous dispersion element 1 of polymer containing black pigment] except that the pigment was changed to C.I. Pigment Yellow 74.

Preparation of Ink

[Yellow ink 1] was prepared in the same manner as in [Black ink 1] except that [Aqueous dispersion element 4 of polymer containing yellow pigment] mentioned above was used in an amount of 28% by weight.

Manufacturing Example 12

Manufacturing of Black Ink 2

Preparation of Aqueous Dispersion Element 5 of Polymer Containing Surface-Treated Black Pigment 90 g of carbon black having a CTAB specific surface area of 150 $m^2/g$ and an DBP oil absorption amount of 100 ml/100 g was added to 3,000 ml of 2.5 normal sodium sulfate solution followed by stirring at 300 rotation per minute (rpm) at 60° C. to conduct reaction for ten hours for oxidation treatment.

The reaction liquid was filtrated and the thus-filtered carbon black was neutralized by sodium hydroxide solution followed by ultra-filtration.

The thus-obtained carbon black was washed with water. The carbon black was dried and dispersed in pure water (deionized water) such that the solid portion of the carbon black was 30% by weight followed by sufficient stirring to obtain [Aqueous Liquid dispersion 5 of polymer containing surface-treated black pigment].

Preparation of Ink

The liquid mixture having the following recipe was stirred for an hour to mix uniformly. 10% by weight of [Aqueous dispersion element 5 of polymer containing surface-treated black pigment] mentioned above was added thereto and water was added such that the total was 100% by weight followed by stirring for an hour.

Thereafter, [Black ink 2] was obtained by filtering the resultant with a membrane filter having an average hole diameter of 1.5 μm.

| | |
|---|---|
| Surface active agent (ZONYL FS-300, manufactured by DuPont Kabushiki Kaisha): | 1.2 parts |
| Wetting agent (1,3-butane diol): | 24 parts |
| Wetting agent (glycerin): | 10 parts |
| Penetrating agent (2-ethyl-1,3-hexane diol): | 2 parts |
| Defoaming agent (silicone defoaming agent KM72, manufactured by ShinEtsu Chemical Co. Ltd.): | 0.2 parts |

Manufacturing Example 13

Preparation of Cyan Ink 2

[Cyan ink 2] was prepared in the same manner as in [Black ink 2] except that the [Aqueous dispersion element 2 of cyan pigment containing polymer particulate] mentioned above was used in an amount of 15% by weight instead of [Aqueous liquid dispersion 5 of polymer containing surface-treated black pigment] in an amount of 10% by weight.

Manufacturing Example 14

Preparation of Magenta Ink 2

[Magenta ink 2] was prepared in the same manner as in [Black ink 2] except that [Aqueous dispersion element 3 of polymer containing magenta pigment] described above was used in an amount of 18% by weight instead of [Aqueous liquid dispersion 5 of polymer containing surface-treated black pigment] in an amount of 10% by weight.

Manufacturing Example 15

Preparation of Yellow Ink 2

[Yellow ink 2] was prepared in the same manner as in [Black ink 2] except that [Aqueous dispersion element 4 of polymer containing yellow pigment] described above was used in an amount of 15% by weight instead of [Aqueous liquid dispersion 5 of polymer containing surface-treated black pigment] in an amount of 10% by weight.

Recipes (% by weight) of each ink are shown in Table 2.

TABLE 2

| Kind of ink | | Black ink 1 | Cyan Ink 1 | Magenta ink 1 | Yellow ink 1 | Black ink 2 | Cyan ink 2 | Magenta ink 2 | Yellow ink 2 |
|---|---|---|---|---|---|---|---|---|---|
| Colorant | Aqueous dispersion element 1 of polymer containing black pigment | 33 | | | | | | | |
| | Aqueous dispersion element 2 of polymer containing cyan pigment | | 28 | | | | 15 | | |
| | Aqueous dispersion element 3 of polymer containing magenta pigment | | | 32 | | | | 18 | |
| | Aqueous dispersion element 4 of polymer containing yellow pigment | | | | 28 | | | | 15 |
| | Aqueous dispersion element 5 of polymer containing surface-treated black pigment | | | | | 10 | | | |
| Surface active agent | DSN403N | 0.1 | 0.1 | 0.1 | 0.1 | | | | |
| | FS300 | | | | | 1.2 | 1.2 | 1.2 | 1.2 |

TABLE 2-continued

| Kind of ink | | Black ink 1 | Cyan Ink 1 | Magenta ink 1 | Yellow ink 1 | Black ink 2 | Cyan ink 2 | Magenta ink 2 | Yellow ink 2 |
|---|---|---|---|---|---|---|---|---|---|
| Hydro-soluble organic solvent | 1,3-butane diol | 20 | 20 | 20 | 20 | 24 | 24 | 24 | 24 |
| | Glycerin | 10 | 10 | 10 | 10 | 10 | 10 | 10 | 10 |
| Permeating agent | 2-ethyl-1,3-hexane diol | 2 | 2 | 2 | 2 | 2 | 2 | 2 | 2 |
| De-foaming agent | AD01 | 0.2 | 0.2 | 0.2 | 0.2 | 0 | 0 | 0 | 0 |
| | KM72F | 0 | 0 | 0 | 0 | 0.1 | 0.1 | 0.1 | 0.1 |
| Deionized water | | Rest | Rest | Rest | Rest | Rest | Rest | Rest | Rest |

Unit of each material: % by weight

Example 1

[Pre-processing fluid A] was applied to a recording medium (Product name: OK top coat+, Weight=104.7 g/m$^2$, manufactured by Oji Paper Co., Ltd.) in an amount of 1.5 g/m$^2$ for pre-processing.

[Black ink 1] was applied to the pre-processed recording medium using the inkjet printer illustrated in FIG. 3. Thereafter, [post-processing fluid 1] in an amount of 5% by volume of the ink applied to form the image was applied thereto followed by drying by heated wind.

Example 2

The image of Example 2 was formed in the same manner as in Example 1 except that the application amount of [Post-processing fluid 1] was changed to 10% by volume of the ink applied to form the image.

Example 3

The image of Example 3 was formed in the same manner as in Example 1 except that the application amount of [Post-processing fluid 1] was changed to 15% by volume of the ink applied to form the image.

Example 4

The image of Example 4 was formed in the same manner as in Example 1 except that the application amount of [Post-processing fluid 1] was changed to 30% by volume of the ink applied to form the image.

Example 5

The image of Example 5 was formed in the same manner as in Example 1 except that the application amount of [Post-processing fluid 1] was changed to 3% by volume of the ink applied to form the image.

Example 6

The image of Example 6 was formed in the same manner as in Example 1 except that the application amount of [Post-processing fluid 1] was changed to 35% by volume of the ink applied to form the image.

Example 7

The image of Example 7 was formed in the same manner as in Example 3 except that [Post-processing fluid 1] was changed to [Post-processing fluid 2].

Example 8

The image of Example 8 was formed in the same manner as in Example 3 except that [Post-processing fluid 1] was changed to [Post-processing fluid 3].

Example 9

The image of Example 9 was formed in the same manner as in Example 3 except that [Post-processing fluid 1] was changed to [Post-processing fluid 4].

Example 10

The image of Example 10 was formed in the same manner as in Example 3 except that [Post-processing fluid 1] was changed to [Post-processing fluid 5].

Example 11

The image of Example 11 was formed in the same manner as in Example 3 except that [Post-processing fluid 1] was changed to [Post-processing fluid 6].

Example 12

The image of Example 12 was formed in the same manner as in Example 3 except that the image was formed without drying by heated wind.

Example 13

The image of Example 13 was formed in the same manner as in Example 3 except that no [Pre-processing fluid A] was applied to form the image.

Example 14

The image of Example 14 was formed in the same manner as in Example 1 except that the application amount of [Post-processing fluid 1] was changed to 20% by volume of the ink applied to form the image.

Example 15

The image of Example 15 was formed in the same manner as in Example 14 except that [Black ink 1] was changed to [Cyan ink 1].

Example 16

The image of Example 16 was formed in the same manner as in Example 14 except that [Black ink 1] was changed to [Magenta ink 1].

Example 17

The image of Example 17 was formed in the same manner as in Example 14 except that [Black ink 1] was changed to [Yellow ink 1].

Example 18

The image of Example 18 was formed in the same manner as in Example 3 except that [Black ink 1] was changed to [Black ink 2].

Example 19

The image of Example 19 was formed in the same manner as in Example 18 except that [Black ink 2] was changed to [Cyan ink 2].

Example 20

The image of Example 20 was formed in the same manner as in Example 18 except that [Black ink 2] was changed to [Magenta ink 2].

Example 21

The image of Example 21 was formed in the same manner as in Example 18 except that [Black ink 2] was changed to [Yellow ink 2].

Comparative Example 1

The image of Comparative Example 1 was formed in the same manner as in Example 1 except that no [Post-processing fluid 1] was applied to form the image.

Comparative Example 2

The image of Comparative Example 2 was formed in the same manner as in Example 1 except that the application amount of [Post-processing fluid 1] was changed to 100% by volume of the ink applied to form the image.

The images formed as described above were evaluated according to the following criteria: The results are shown in Table 3.

Image Density

The image density of a solid square image (100% duty) of black having a 10 point was measured about by a reflection type color spectrodensitometer (manufactured by X-Rite Inc.).

Evaluation Criteria

E (Excellent): 1.5 or higher

G (Good): 1.2 to less than 1.5

F (Fair): 0.9 to less than 1.2

B (Bad): Less than 0.9

Image Feathering

Evaluation criteria for visual observation of a text image of H having a 10 point printed with a definition of 1,200 dpi.

E (Excellent): No feathering observed

G (Good): Feathering slightly observed

F (Fair): Feathering observed

B (Bad): Feathering clearly observed

Smearing Fixing Property

As the image chart, a square solid image of 6 cm×6 cm was printed with 100 duty, Three or longer hours after the printing, white cotton cloth (manufactured by TOYO SEIKI Co., Ltd.) attached to a clock meter (manufactured by TOYO SEIKI Co., Ltd.) was moved back and forth on the printed solid image portion ten times and the ink attached to the white cotton was visually observed to make evaluation according to the following criteria:

Evaluation Criteria

E (Excellent): Free from contamination

G (Good): Contamination observed but with no practical problem

F (Fair): Slightly substantial contamination observed

B (Bad): Substantial contamination observed

Blocking Resistance

TAPPI T477 testing method issued by Japan Technical Association of the Pulp and Paper industry (Japan TAPPI) was referred to evaluate the blocking resistance as follows: A solid portion of 6 cm×6 cm was printed on a recording medium; Another recording medium was placed on the solid portion; both recording media were sandwiched by two glass plates of 10 cm×10 cm; The recording media and the glass plates were left undone for 24 hours at 40° C. and 90% relative humidity while a load of 1 kg/m$^2$ for 24 hours was applied thereto; After left undone for two more hours at room temperature, the recording media were peeled off to visually observe and evaluate the blocking degree of the recording media according to the following evaluation criteria.

E (Excellent): No blocking observed (No clinging or attachment occurred at the contact surfaces, which were slid freely from each other with no damage to the printed surface).

G (Good): Blocking slightly observed (slightly clinging to each other, it was not possible to freely slide the media but they were slid by pressing and frictioning. The printed surface was lightly or unrecognizably damaged.)

F (Fair): Blocking significantly observed (the contact surfaces clung or attached to each other. Each layer was not easily detached. The contact surface was damaged or partially damaged.)

B (Bad): Blocking clearly observed (the degree of blocking was that the contact surfaces were completely attached and bonded and the printed surface was destroyed and the fiber of the recording medium was torn and detached if forced to be detached.)

TABLE 3

| | Pre-processing fluid | Ink | Post-processing fluid | Amount *(% by vol.) | *Heating | Image density | Feathering of image | Smear fixability | Blocking resistance |
|---|---|---|---|---|---|---|---|---|---|
| Ex. 1 | A | K1 | No. 1 | 5 | Yes | E | E | G | G |
| Ex. 2 | A | K1 | No. 1 | 10 | Yes | E | E | E | E |
| Ex. 3 | A | K1 | No. 1 | 15 | Yes | E | E | E | E |
| Ex. 4 | A | K1 | No. 1 | 30 | Yes | E | E | E | E |
| Ex. 5 | A | K1 | No. 1 | 3 | Yes | E | E | F | F |
| Ex. 6 | A | K1 | No. 1 | 35 | Yes | E | G | E | G |
| Ex. 7 | A | K1 | No. 2 | 15 | Yes | E | E | E | G |
| Ex. 8 | A | K1 | No. 3 | 15 | Yes | E | E | G | G |
| Ex. 9 | A | K1 | No. 4 | 15 | Yes | G | G | E | G |
| Ex. 10 | A | K1 | No. 5 | 15 | Yes | G | G | G | G |
| Ex. 11 | A | K1 | No. 6 | 15 | Yes | G | F | F | G |
| Ex. 12 | A | K1 | No. 1 | 15 | No | G | G | E | G |
| Ex. 13 | None | K1 | No. 1 | 15 | Yes | G | E | E | G |
| Ex. 14 | A | K1 | No. 1 | 20 | Yes | E | E | E | E |
| Ex. 15 | A | C1 | No. 1 | 20 | Yes | E | E | E | E |
| Ex. 16 | A | M1 | No. 1 | 20 | Yes | E | E | E | E |
| Ex. 17 | A | Y1 | No. 1 | 20 | Yes | E | E | E | E |
| Ex. 18 | A | K2 | No. 1 | 15 | Yes | E | E | E | E |
| Ex. 19 | A | C2 | No. 1 | 15 | Yes | E | E | E | E |
| Ex. 20 | A | M2 | No. 1 | 15 | Yes | E | E | E | E |
| Ex. 21 | A | Y2 | No. 1 | 15 | Yes | E | E | E | E |
| Comp. Ex. 1 | A | K1 | No. 1 | 0 | Yes | E | E | F | F |
| Comp. Ex. 2 | A | K1 | No. 1 | 100 | Yes | G | B | F | F |

*(% by vol.): Rate (% by volume) of the amount of applied post-processing fluid to the amount of applied ink
*Heating: Drying with heated wind
K: Black
C: Cyan
M: Magenta
Y: Yellow As seen in the detailed description, the present invention reduces transfer contamination of post-processing fluid and ink and improve blocking resistance, thereby preventing degradation of the quality of images on a recording medium having a low absorption level such as coated paper for offset printing.

Having now fully described embodiments of the present invention, it will be apparent to one of ordinary skill in the art that many changes and modifications can be made thereto without departing from the spirit and scope of embodiments of the invention as set forth herein.

What is claimed is:

1. An inkjet recording method comprising:

forming an image on a coated layer provided at least one side of a substrate of a recording medium with ink comprising a colorant; and then applying a post-processing fluid comprising a resin to the image already formed by the ink;

wherein an application amount per unit area of the post-processing fluid to the image already formed by the ink is controlled to be less than an application amount per unit area of the ink that forms the image, wherein the application amount of the post-processing fluid applied on the image already formed by the ink is in a range from 5% by volume to 30% by volume of the application amount of the ink that forms the image, and wherein the resin comprises a urethane resin and a vinyl polymer, and a content of the resin comprising the urethane resin and the vinyl polymer is from 3% by weight to 10% by weight based on a total amount of the post-processing fluid.

2. The inkjet recording method according to claim 1, wherein an application area of the post-processing fluid ranges from 5% to 30% of an application area of the ink applied to form the image.

3. The inkjet recording method according to claim 1, wherein the post-processing fluid comprises a polyethylene wax.

4. The inkjet recording method according to claim 1, wherein the post-processing fluid comprises a polyether-modified polydimethyl siloxane.

5. The inkjet recording method according to claim 1, further comprising: processing the coated layer with a pre-processing fluid prior to the step of forming the image with the ink.

6. The inkjet recording method according to claim 5, wherein the pre-processing fluid comprises a hydrosoluble aliphatic organic acid.

7. The inkjet recording method according to claim 1, further comprising heating the recording medium after the step of applying the post-processing liquid to the recording medium.

8. An inkjet recording device comprising:

an ink container to accommodate ink;

a recording head to discharge ink to form an image on a recording medium; and a post-processing fluid supplying device to apply droplets of a post-processing fluid comprising a resin onto the image already formed by the ink, wherein an application amount of the post-processing fluid applied on the image already formed by the ink is in a range from 5% by volume to 30% by volume of an application amount of the ink that forms the image, and wherein the resin comprises a urethane resin and a vinyl polymer, and a content of the resin comprising the urethane resin and the vinyl polymer is from 3% by weight to 10% by weight based on a total amount of the post-processing fluid.

9. An inkjet recording method comprising:

forming, with a full-line type recording head, an image on a coated layer provided at least one side of a substrate of a recording medium with ink comprising a colorant; and then applying a post-processing fluid comprising a resin to the image already formed by the ink on the recording medium, and controlling an application amount per unit area of the post-processing fluid to the image already formed by the ink, to be less than an application amount per unit area of the ink to form the image, wherein an application area of the post-processing fluid applied on the image already formed by the ink is in a range from 5% to 30% of an application area of the ink that forms the image, and wherein the resin comprises a urethane resin and a vinyl polymer, and a content of the resin comprising the urethane resin and the vinyl polymer is from 3% by weight to 10% by weight based on a total amount of the post-processing fluid.

10. The inkjet recording method according to claim 9, wherein the application amount of the post-processing fluid ranges from 5% by volume to 30% by volume of the application amount of the ink to form the image.

11. The inkjet recording method according to claim 9, wherein the post-processing fluid comprises a polyethylene wax.

12. The inkjet recording method according to claim 9, wherein the post-processing fluid comprises a polyether-modified polydimethyl siloxane.

13. The inkjet recording method according to claim 9, further comprising: processing the coated layer with a pre-processing fluid prior to the step of forming the image with the ink.

14. The inkjet recording method according to claim 13, wherein the pre-processing fluid comprises a hydrosoluble aliphatic organic acid.

15. The inkjet recording method according to claim 9, further comprising: heating the recording medium after the step of applying the post-processing liquid to the recording medium.

* * * * *